US006494267B2

(12) United States Patent
Allen

(10) Patent No.: US 6,494,267 B2
(45) Date of Patent: Dec. 17, 2002

(54) WELLHEAD ASSEMBLY FOR ACCESSING AN ANNULUS IN A WELL AND A METHOD FOR ITS USE

(75) Inventor: Timothy J. Allen, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/726,007

(22) Filed: Nov. 29, 2000

(65) Prior Publication Data

US 2002/0062965 A1 May 30, 2002

(51) Int. Cl.[7] ..... E21B 33/035

(52) U.S. Cl. ..... 166/347; 166/368

(58) Field of Search ..... 166/368, 344, 166/347, 348, 360

(56) References Cited

U.S. PATENT DOCUMENTS

| | | | | |
|---|---|---|---|---|
| 4,564,068 A | * | 1/1986 | Baugh | 166/123 |
| 4,942,929 A | | 7/1990 | Malachosky et al. | 175/66 |
| 5,085,277 A | | 2/1992 | Hopper | 166/341 |
| 5,129,469 A | | 7/1992 | Jackson | 175/66 |
| 5,226,478 A | | 7/1993 | Henderson, Jr. et al. | 166/285 |
| 5,255,745 A | | 10/1993 | Czyrek | 166/347 |
| 5,339,912 A | | 8/1994 | Hosie et al. | 175/66 |
| 5,341,882 A | | 8/1994 | Hale | 166/293 |
| 5,372,199 A | | 12/1994 | Cegielski et al. | 166/368 |
| 5,544,707 A | | 8/1996 | Hopper et al. | 166/382 |
| 5,613,242 A | | 3/1997 | Oddo | 588/17 |
| 5,662,169 A | | 9/1997 | Hosie | 166/344 |
| 5,884,715 A | | 3/1999 | Reddoch | 175/66 |
| 6,039,119 A | | 3/2000 | Hopper et al. | 166/368 |
| 6,062,314 A | * | 5/2000 | Nobileau | 166/368 |

OTHER PUBLICATIONS

Ferguson et al. "Subsea Cuttings Injection Guide Base Trial" Offshore European Conference; SPE 26681, Sep. 7–10, 1993.

Saasen et al. "The First Cuttings Injection Operation Worldwide in a Subsea Annulus: Equipment and Operational Experience" SPE Annual Technical Conference and Exhibition; SPE 48985 Sep. 27–30, 1998.

Brochure, Kvaerner Oil & Gas, "Subsea Wellhead System", 1999, 8 Pages.

DRIL–QUIP, General Catalog, "*Special Applications, Cuttings Injection System*", 1994, p. 34.

* cited by examiner

*Primary Examiner*—David Bagnell
*Assistant Examiner*—Zakiya Walker
(74) *Attorney, Agent, or Firm*—Michael P. Hartmann; Peter A. Bielinski; Jackie L. Duke

(57) ABSTRACT

A wellhead assembly comprises a central bore through the wellhead assembly having a pressure boundary region. A port is provided in the wellhead assembly having an opening in the central bore in the pressure boundary region of the wellhead assembly. The port preferably extends through the high pressure housing into the bore of the wellhead assembly. A first casing string is secured at a first end within the wellhead assembly below the opening of the port in the central bore of the wellhead assembly. A second casing string is secured at a first end within the wellhead assembly above the opening of the port in the central bore of the wellhead assembly. A fluid flowpath is thereby formed comprising the port in the wellhead assembly and an annulus between the first and second casing strings. In this way, access is provided to an annulus within the well. A method for passing a fluid through an annulus in a well is also provided, the well having a wellhead assembly comprising a central bore therethrough, the annulus being formed between a first casing string and a second casing secured within the wellhead assembly and extending into the well.

19 Claims, 3 Drawing Sheets

WELLHEAD ASSEMBLY FOR ACCESSING AN ANNULUS IN A WELL AND A METHOD FOR ITS USE

TECHNICAL FIELD OF THE INVENTION

The present invention relates to a wellhead assembly for accessing an annulus within a well, especially a subsea well, in particular an annulus between adjacent casing strings within the well. The present invention further relates to a method of accessing an annulus within a well, in particular a subsea well, and the use of the method in the injection of fluids into the well or the production of fluids from the well.

BACKGROUND OF THE INVENTION

A range of well operations requires access to an annulus between adjacent casing strings within the well. For example, it is often required to produce or displace fluids from the well through such an annulus, such as when drilling operations are underway. In addition, it is also a known practice to inject fluids into the well and underground formations into which the well extends through such an annulus. One operation involving such an injection of fluid is the disposal of cuttings.

The drilling of an oil or gas well, for example a subsea well, results in the formation of small fragments of rock and other matter, known as cuttings, from the various formations through which the-well is drilled. The cuttings are removed from the well as they are formed by the drill bit by being entrained in a drilling mud pumped down the well and returned to the surface vessel or platform. The cuttings are typically recovered from the drilling mud by a separation process and the mud reused in the well operations. In the past, at offshore locations, it has been common practice to dispose of the cuttings separated from the drilling mud in this way by dumping them in the sea. This practice has proven acceptable in the past, as the environmental impact from the negligible amounts of entrained oil based mud in the cuttings was low. Additionally, may companies have changed their practice to use synthetic drilling mud that is environmentally friendly.

Recently, however, it has become favored to employ oil based drilling muds, as such mud formulations offer a number of advantages. For example, oil based muds improve the stability of the well bore, improve the performance of the drill bit by providing better lubrication and removal of cuttings as they are formed, and reduce the torque generated in the drill string during use. For these reasons, oil based drilling muds have been finding increasing use. While offering advantages during the drilling operation, the oil based mud formulations present a problem with respect to disposal. Cuttings separated from the oil based muds after recovery from the well are inevitably contaminated with the oil based formulation. Washing the cuttings has been attempted, but only removes the mud from the surface of the cuttings particles, leaving oil in the cracks and pores of the fragments. It is no longer possible to dispose of cuttings recovered from an offshore well using oil based drilling muds in the same manner as when water based muds are employed by simply pouring the cuttings into the sea, as the cuttings give rise to an adverse environmental impact. The corresponding environmental regulations have become more stringent year by year, decreasing the allowable quantities of entrained oil based mud present in the washed cuttings.

Accordingly, it has been the practice to dispose of the cuttings by injecting them into a well and into subsurface formations. To facilitate this, it has been the practice to grind the cuttings and suspend them in a suitable liquid to form a pumpable slurry, which may then be injected into a subsurface formation through an annulus between adjacent casings in the well. This has been common practice in environmentally sensitive areas, such as the north slope of Alaska, for many years.

US Pat. No. 4,942,929 discloses a method for the disposal and reclamation of drilling wastes, in which construction grade gravel is separated from drilling cuttings produced during well drilling operations. The solids that are not so recovered are formed as a slurry with the remaining clays, silts and spent drilling fluid and conducted to a second well, remote from the well being drilled, into which the slurry is injected. Centrifugal pumps or mechanical agitators are used to disperse the fine solids in the slurry to assist in the injection process.

A drill cuttings disposal method and system are disclosed in U.S. Pat. No. 5,129,469. In the method and system disclosed, drill cuttings produced during well drilling operations are brought to the surface and separated from the drilling mud, mixed with a suitable liquid, such as sea water and the mixture subjected to grinding to form a slurry. The slurry may then be pumped into a selected zone of the well for disposal.

U.S. Pat. No. 5,341,882 discloses a method for the disposal of well drilling cuttings, in which the cuttings are solidified by combining the cuttings with water and blast furnace slag. The resulting mixture is injected into the annulus between two wellbore casings, where it solidifies to form a cement.

U.S. Pat. No. 5,884,715 discloses a method and apparatus for injecting cuttings into a well while drilling operations are in progress. Two embodiments are discussed in the disclosure. The first method requires a predrilled well bore to be bored adjacent to and extending away from the well being drilled. The predrilled well bore is used as a depository for the drilling cuttings produced from the well being drilled. The second embodiment requires an injection tube to be installed within the well being drilled alongside the casings set into the well, through which access can be gained to subsurface formations into which the cuttings may be injected. A further embodiment employs an annulus between adjacent casings in the well in order to gain access to underground formations. It is noted that the embodiments disclosed in U.S. Pat. No. 5,884,715 relate to the injection of cuttings into a well having a wellhead accessible on land. While subsea operations are mentioned, little information is given regarding the injection of cuttings into subsea wells.

A subsea wellhead typically comprises a conductor pipe extending below the sea bed in the well, the upper portion of which extends from the well and forms a conductor housing. A high pressure housing is landed in the conductor housing, on which is typically mounted a blowout preventer (BOP) stack by means of a BOP guide funnel. Successively smaller casings are landed in the wellhead, suspended from casing hangers secured within the conductor pipe or the high pressure housing. The pressure boundary region of the wellhead assembly is that region of the assembly between the first or upper end of the high pressure housing and the lowermost casing hanger seal assembly. A guide base is often employed, which comprises a structure extending around the wellhead and mounted to the conductor housing.

A subsea well injection system is disclosed in U.S. Pat. No. 5,085,277, for injecting unwanted slurries and other fluids arising from drilling or other downhole operations into a subsea well. The slurry or other fluid is injected through a drilling guide base positioned around the well on an underwater surface. The system employs a dedicated guide base, which comprises pipework on the guide base leading to a port in the conductor casing of the well, thus gaining access to the annulus between the conductor casing and the adjacent inner casing. A fail safe isolation valve is provided on the guide base and joined to the pipework. A coupling is provided to connect the isolation valve to a surface vessel or platform. The wellhead is modified to provide a port in the housing, in order to gain access to an annulus between casings within the well. With a single port in the outermost casing of the well, fluids may be injected into the outermost annulus of the well. If access is required to an inner annulus, similar ports are required in the casings disposed radially outwards of the inner annulus to provide a flow path to the pipework extending from the guide base.

In U.S. Pat. No. 5,339,912, there is disclosed a cuttings disposal system in which an injection adapter is employed to allow a slurry of cuttings to be injected into a well. The well, designated an "injection well", has an inner and an outer wellhead housing with at least one casing hanger and a respective inner casing installed in the inner wellhead housing. The casing hanger is formed with a port through it, connecting the bore of the well with the annulus between the inner casing and the outer casing of the well. When it is desired to inject cuttings into the well, an injection adapter is landed in the wellhead so as to extend into the bore of the well, allowing a central bore in the injection adapter to connect, through a port in the side of the injection adapter body, with the port in the casing hanger. The central bore in the injection adapter is connected by pipework to a pump at the surface, by means of which a slurry of cuttings may be injected through the injection adapter and into the annulus in the well. It is noted that, with the injection adapter landed in the well, access to the well for conducting other operations is denied, until the cuttings injection operation is ceased and the injection adapter removed.

U.S. Pat. No. 5,255,745 describes a method and apparatus for providing a remotely operable connection to establish access to an annulus within a wellhead assembly. The apparatus requires a port in the wellhead assembly. A valve is positioned to seal with the port by remote means using a ramp assembly supported on a guide base positioned around the wellhead. U.S. Pat. No 5,255,745 does not, however, address the wellhead equipment necessary in order to gain access in the wellhead to the annulus mentioned.

A cuttings injection wellhead system for use in subsea wells is disclosed in U.S. Pat. No. 5,662,169. The wellhead system employs a wellhead having a conductor casing, to which is mounted a conductor housing and around which a guide base is provided. A high pressure housing is landed in the conductor housing. The wellhead system comprises an extension to the conductor housing extending between the lower end of the conductor housing and the conductor casing. A port is formed in the conductor housing extension below the guide base, allowing access to the interior of the conductor housing. A similar extension is provided on the lower end of the high pressure housing, formed with a corresponding port aligned with the port in the conductor casing. An inner casing is suspended from a casing hanger disposed within the high pressure housing. The ports in the extensions to the conductor housing and high pressure housing provide access to the annulus around the inner casing, into which a slurry of drilling cuttings may be injected. The pipework necessary to connect with the port in the conductor housing extension depends from the guide base provided around the wellhead assembly. The wellhead system of U.S. Pat. No. 5,662,169 requires the use of a modified conductor housing and high pressure housing, both of which must be provided with extensions through which aligned ports must be bored. In addition, the system of U.S. Pat. No. 5,662,169 requires the use of a dedicated guide base with the necessary pipework and connections in order to allow cuttings injection to proceed.

In a paper entitled "Subsea Cuttings Injection Guide Base Trial" presented at the Offshore European Conference, Sep. 7 to 10, 1993, Ferguson et al. disclosed the results of field trials conducted to test a permanent guide base and wellhead assembly modified to allow cuttings injection. A modified permanent guide base was employed having a pipe connecting through the guide base to a port in an extension welded to the conductor housing of the wellhead. A similar extension was provided on the lower end of the high pressure housing, through which a port was formed to align with the port in the extension to the conductor housing and provide access to an inner annulus of the wellhead assembly. As with the system of U.S. pat. No. 5,662,169, a dedicated guide base is required in this system in order to provide the possibility of cuttings injection, together with modifications to several of the wellhead components.

A similar cuttings injection system is disclosed by Saasen et al. in a paper entitled "The First Cuttings Injection Operation Worldwide in a Subsea Annulus: Equipment and Operational Experience", presented at the SPE Annual Technical Conference and Exhibition, Sep. 27 to 30, 1998. Again, this system employs a modified guide base, required to be larger than conventional guide bases, through which access is gained to a port formed in the conductor housing. A similar port is provided in the high pressure housing, aligned with the port in the conductor housing, in order to access an annulus between the high pressure housing, and its associated casing, and a casing suspended from a casing hanger secured in the bore of the high pressure housing. Again, the system of Saasen et al. requires a modified, dedicated guide base to be provided in order to inject cuttings into an annulus within the wellhead assembly. Further, in the system of Saasen et al. seal cartridges are required to be provided within the conductor housing around the high pressure housing both above and below the ports in the conductor housing and high pressure housing, in order to avoid ingress of the cuttings slurry into the annulus between the conductor housing and the high pressure housing.

It is noted that the prior art teaches, in general, that it is required to employ a guide base in order to gain access to an annulus within the wellhead assembly and the well, in order to effect cuttings injection into a subsea wellhead. Reference is made to U.S. Pat. No. 5,085,077, U.S. Pat. No. 5,255,745, U.S. Pat. No. 5,662,169 and the papers by Ferguson et al. and Saasen et al. In addition, the systems proposed required significant modifications to the components of the wellhead assembly in order to provide access to the annulus of choice within the well. It would be advantageous if a method and apparatus could be found for accessing an annulus within a wellhead assembly and the well without requiring substantial modifications to the conventional wellhead assembly components. It would be a further advantage if the need for a guide base, in particular a modified, dedicated guide base, could be dispensed.

It is also noted that, in general, the aforementioned proposals require an access port to be formed in the conductor housing of the wellhead assembly. It would also be an advantage if the need to provide an opening or port in the conductor housing could be removed and access provided to an annulus within the wellhead assembly and the well without requiring modification to the conductor housing or the conductor casing.

As can also be seen from a review of the prior art, a number of the proposals to date require a port to be formed in the wall of a casing hanger within the wellhead assembly, in order to access an annulus within the well. Reference is made to U.S. Pat. No. 5,339,912. This design requires that the port in the casing hanger be sealed, when it is required to conduct well operations through the bore of the wellhead assembly that do not require access to the annulus. If the seals fail, the fluids in the well bore, being at a higher pressure than the annulus accessed by the port, would flow into the annulus. These fluids could be at a pressure in excess of the burst pressure of the outer casing, leading to a rupture of the casing. Alternatively, the fluids entering the annulus could find their way into a low pressure formation, from where they could access the surface, for example through a fault. This would in turn lead to harm to the subsea environment in the region of the breach. Finally, as has already been noted, access to the port in the casing hanger can only be obtained from within the bore of the wellhead assembly, requiring the use of a tool, which in turn closes the bore and prevent its use for other well operations.

There is clearly a need for a way to access an annulus within a wellhead assembly and the associated well, for example to inject drilling cuttings into the well, while keeping the modifications required to the conventional or existing equipment to a minimum. Further, it would be most advantageous to be able to have such access and carry out the required operations without requiring a guide base to be present. It would be of further advantage if access could be obtained to the annulus, for example to inject cuttings into the well, while drilling and other well operations were proceeding at the same time.

SUMMARY OF THE INVENTION

According to a first aspect of the present invention there is provided a wellhead assembly comprising:

a central bore through the wellhead assembly;

a pressure boundary region;

a port in the wellhead assembly having an opening in the central bore in the pressure boundary region of the wellhead assembly;

a first casing string secured at a first end within the wellhead assembly below the opening of the port in the central bore of the wellhead assembly; and a second casing string secured at a first end within the wellhead assembly above the opening of the port in the central bore of the wellhead assembly;

thereby forming a fluid flowpath comprising the port in the wellhead assembly and an annulus between the first and second casing strings.

The wellhead assembly provides an arrangement for accessing an annulus within the wellhead assembly and the well requiring only minimal modification of the existing or conventional wellhead assembly components. In particular, it is possible to employ conventional casing strings and casing hangers, with no modification being required. In addition, the access to the annulus is provided without requiring extra seals to be employed to maintain the integrity of the flowpath and isolate it from the central bore of the wellhead assembly and the well. Indeed, the wellhead assembly simply requires the conventional subsea seals and pack-offs to secure and seal the casing strings and their associated casing hangers within the wellhead assembly.

It is also to be noted that, unlike the prior art, access is gained to an inner annulus within the wellhead assembly and the well without requiring the conductor housing to be penetrated. In this way, the integrity of the conductor housing is not compromised.

The wellhead assembly preferably comprises a high pressure housing, the port in the wellhead assembly being in the high pressure housing. In such an arrangement, the first casing string may be secured in the high pressure housing, for example using a conventional casing hanger, below the opening of the port. The second casing string may be secured in the high pressure housing above the opening of the port, again using a conventional casing hanger.

It is also to be understood that further casing hangers may be disposed either above and/or below the opening of the port into the central bore, from which further casing strings may be suspended. In the case in which further casing hangers and their respective casings are provided below the opening of the port in the central bore, access to two or more annuli between such casings may be provided, for example by providing the appropriate casing hanger with ports therethrough.

In a preferred embodiment, a sleeve is disposed within the wellhead assembly between the first ends of the first and second casing strings. The sleeve is formed with one or more ports through it, in order to connect the port in the wellhead assembly with the annulus between the first and second casing strings. The cross-sectional area of the port or ports in the sleeve may be greater than that of the port in the wellhead assembly. In this way, the sleeve acts to reduce the velocity of fluid passing through the flowpath. This is of particular importance when injecting a slurry of cuttings into the wellhead assembly and the well. By reducing the velocity of the particles in the slurry, the erosion of the casing hangers and casings by the slurry is reduced. The sleeve may also act as a wear sleeve, to further prevent erosion of and damage to the casing. To achieve this, the port in the sleeve is positioned relative to the port in the wellhead assembly such that a fluid entering or leaving the wellhead assembly is deviated in its path, causing the fluid to first impinge on the sleeve, before passing through the port in the sleeve. In a preferred arrangement, the port in the sleeve is disposed such that the flowpath between the port in the wellhead assembly and the annulus comprises two such deviations. It should be noted that standard hanger body design incorporates ports for the bypass of annulus fluid during casing hanger running and casing cementing operations. These ports may be used in addition to or in place of the ports in the sleeve through which the fluid passes.

The sleeve is preferably separate from the first and second casing strings and their hangers. In a preferred arrangement, the sleeve is arranged to be landed in the wellhead assembly together with the second casing string and its associated hanger.

In order to carry out operations in which fluid is passed into and out of the annulus within the well through the wellhead housing of the present invention, it is preferred to provide a riser interface or flowline assembly connected to the port in the wellhead assembly, by which fluid may be transported between a surface vessel or platform and the wellhead assembly using a riser. The interface assembly preferably includes at least one valve for regulating the flow of fluid along the flowpath, the valve preferably being a fail-safe closed valve. The interface assembly can be constructed and installed as a separate, independent assembly, without requiring the presence of a guide base, whether of conventional design or modified in any way.

In a further aspect, the present invention provides a method for providing access to an annulus in a well, the well having a wellhead assembly comprising a central bore therethrough, the annulus being formed between a first casing string and a second casing secured within the wellhead assembly and extending into the well, the method comprising:

providing a port in the wellhead assembly having an opening into the pressure boundary region of the central bore;

securing the first casing string at a first end in the wellhead assembly below the opening of the port in the central bore; and securing the second casing string at a first end in the wellhead assembly above the opening of the port in the central bore;

thereby forming a fluid flowpath comprising the port in the wellhead assembly and the annulus between the first and second casing strings.

The method for providing access to an annulus in the well may employ a wellhead assembly having the features described above.

In a further aspect, the present invention provides a method for passing a fluid through an annulus in a well, the well having a wellhead assembly comprising a central bore therethrough, the annulus being formed between a first casing string and a second casing secured within the wellhead assembly and extending into the well, the method comprising:

providing a port in the wellhead assembly having an opening into the pressure boundary region of the central bore;

securing the first casing string at a first end in the wellhead assembly below the opening of the port in the central bore; and securing the second casing string at a first end in the wellhead assembly above the opening of the port in the central bore;

thereby forming a fluid flowpath comprising the port in the wellhead assembly and the annulus between the first and second casing strings.

The method may advantageously be employed to pass a fluid into the wellhead assembly and the well, in particular a slurry of cuttings for injection into an underground formation. As an alternative, the method may be employed to produce fluids from the well through the annulus, such as drilling muds.

As noted above, it is preferred to provide the flowpath with a deviation in direction between the annulus formed between the first and second casings and the port in the wellhead assembly. In this way, erosion of the casings and casing hangers is reduced. As also noted above, it is preferred if the flowpath comprises at least two deviations in direction between the aforesaid points in the wellhead assembly.

It is an important advantage of the method of this invention that the injection of fluids into the well or the production of fluids from the well may take place while other well and downhole operations, such as drilling, are underway, without interruption of the latter.

Specific embodiments of the apparatus and method of the present invention will now be described in detail having reference to the accompanying drawings. The detailed description of these embodiments and the referenced drawings are by way of example only and are not intended to limit the scope of the present invention.

BRIEF DESCRIPTION OF THE DRAWINGS

Preferred embodiments of the present invention will now be described, by way of example only, having reference to the accompanying drawings, in which.

DETAILED DESCRIPTION OF THE PREFERRED EMBODIMENTS

Figure 1:
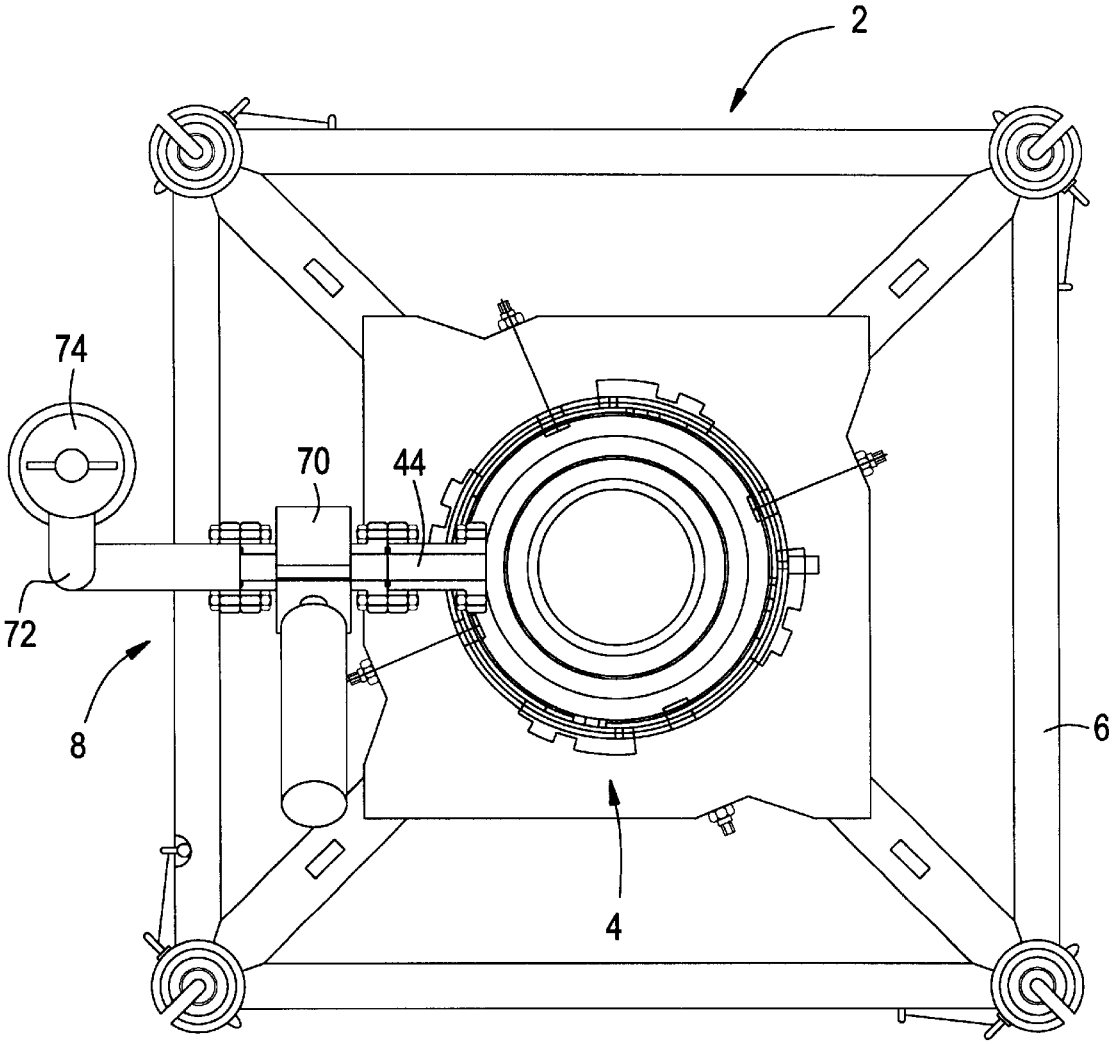
FIG. 1 is a plan view of a wellhead assembly according to the present invention in situ on the seabed.

Referring to FIG. 1, there is shown a plan view of a wellhead located on the seabed above a subsea well. The wellhead, generally indicated as 2, comprises a wellhead assembly according to one embodiment of the present invention, generally indicated as 4, around which is disposed a guide base 6 of conventional design. As already noted, it is not required that a guide base be present in order to use the wellhead assembly or practice the methods of the present invention. The wellhead assembly 4 further comprises a riser interface assembly, generally indicated as 8, described in more detail below.

Figure 2:
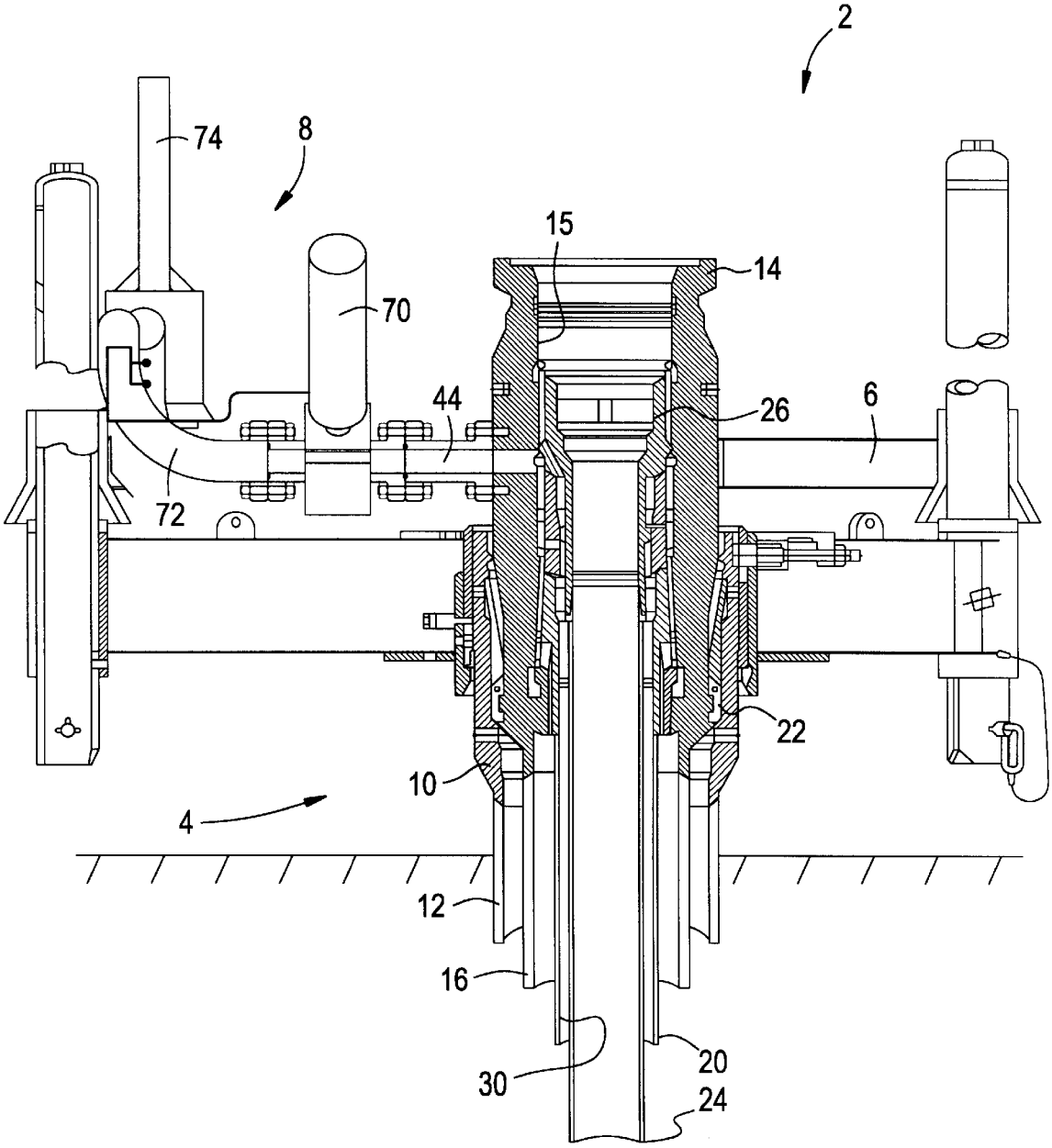
FIG. 2 is a side elevation cross-sectional view of one embodiment of the wellhead assembly of the present invention.

FIG. 2 shows a cross-sectional side elevation of the wellhead of FIG. 1. The wellhead assembly 4 comprises a conductor housing 10 of conventional design, to which is mounted the guide base 6. A conductor pipe 12 is welded to the lower portion of the conductor housing 10 and extends into the well below the seabed. The conductor pipe 12 typically has a nominal diameter of 30 inches. A high pressure housing 14 of substantially conventional design and having a central bore 15 therethrough is secured in the conductor housing 10 in a conventional manner. A high pressure casing 16 is secured to the lower portion of the high pressure housing 14 and extends into the well below the seabed. The high pressure casing 16 typically has a nominal diameter of 20 inches. A first inner casing string 20 is suspended from a first conventional casing hanger 22 secured within the high pressure housing 14 and extends within the high pressure casing 16 into the well. The first inner casing string 20 typically has a nominal diameter of 13 ⅜inches. Similarly, a second inner casing string 24 is suspended from a second conventional casing hanger 26 within the high pressure housing 14 and extends within the first inner casing string 20 into the well. The second inner casing string 24 typically has a nominal diameter of 9 ⅝inches. An annulus 30 is formed between the first inner casing string 20 and the second inner casing string 24, extending into the well to the lower end of the first inner casing string 20, at which point the annulus provides access to an underground formation. The details of the high pressure housing 14, the first and second inner casing strings 20 and 24, and their respective hangers are shown more clearly in FIG. 3.

Figure 3:
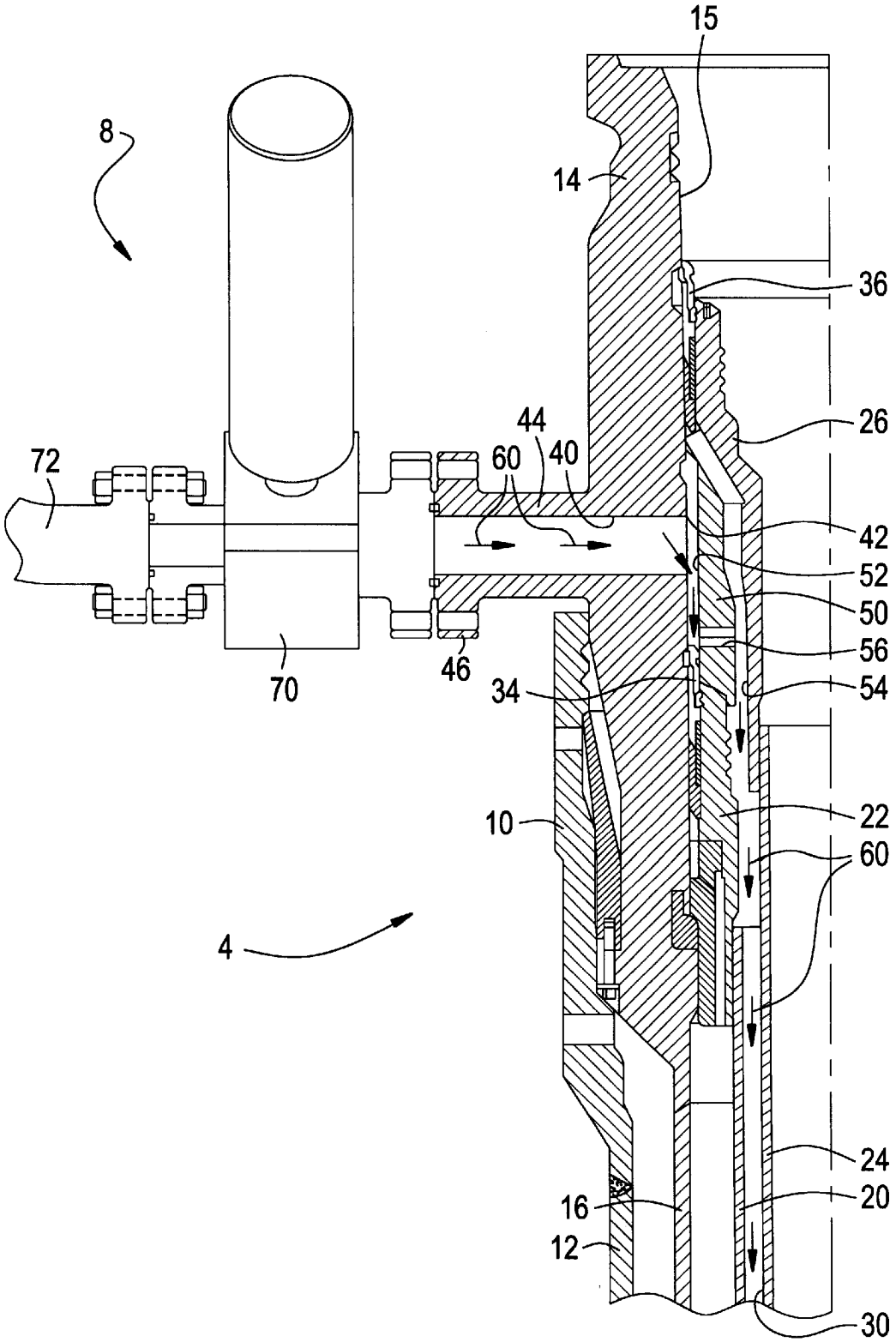
FIG. 3 is an enlarged view of a portion of wellhead assembly of FIG. 2

FIG. 3 is an enlarged cross-sectional view of one half of the wellhead assembly 4 of FIG. 2. As shown in FIG. 3, the first inner casing string 20 is suspended from the first casing hanger 22, which has been landed in the lower portion of the central bore 15 of the high pressure housing 14. A first conventional subsea wellhead pack-off 34 seals the annulus between the first inner casing string 20 and the high pressure casing 16. The first pack-off 34 is arranged to provide an effective seal between the first casing hanger 22 and the high pressure housing 14 at the fall rated working pressure of the wellhead whether applied from above, that is from within the central bore 15 of the high pressure housing 14, or from below, that is from within the annulus between the first inner casing string 20 and the high pressure casing 12. The second inner casing string 24 is secured in a similar manner by means of the second casing hanger 26 located in an upper portion of the central bore 15 of the high pressure housing 14. Thus, a second conventional subsea wellhead pack-off 36 provides a seal between the second casing hanger 26 and the high pressure housing 14.

A port 40 is formed in the high pressure housing 14, having an opening 42 in the central bore 15 of the high pressure housing 14 located between the first casing hanger seal 34 and the second casing hanger seal 36. The port 40 is shown in FIG. 3 as extending radially through the high pressure housing 14, perpendicular to the longitudinal axis of the high pressure housing 14. However, it will be understood that the port 40 may extend at any suitable angle to the longitudinal axis as may be required to access the appropriate region of the central bore 15 of the high pressure housing 14.

A spigot 44 extends from the high pressure housing 14 in connection with the port 40 and terminates in a flange 46, to which is mounted the riser interface assembly 8, as described in more detail below. Any other suitable means of attachment to the port 40 in the high pressure housing 14 known in the art may be employed. For example, the spigot 44 and its flange 46 may be replaced by a male or female threaded member, or a hub for connection using a hydraulic connector commonly employed in the art.

A sleeve 50 is disposed within the central bore 15 of the high pressure housing 14 and extends between the first casing hanger 22 and the second casing hanger 26. An outer annular cavity 52 is formed within the central bore 15 of the high pressure housing 14 between the outer surface of the sleeve 50 and the wall of the high pressure housing 14. The port 40 in the high pressure housing 14 has its opening 42 in the annular cavity 52. An inner annular cavity 54 is formed within the central bore 15 of the high pressure housing 14 between the inner surface of the sleeve 50 and the outer surface of the second inner casing 24. The annular cavity 54 connects with the annulus 30 between the first inner casing string 20 and the second inner casing string 24. A port 56 is formed in the sleeve 50 and connects the outer annular cavity 52 with the inner annular cavity 54. A fluid flowpath, indicated by the arrows 60, is defined by the port 40 in the high pressure housing 14, the outer annular cavity 52, the port 56 in the sleeve 50, the inner annular cavity 54 and the annulus 30 between the first inner casing string 20 and the second inner casing string 24 extending into the well.

The port 56 in the sleeve 50 is shown in FIG. 3 as extending radially through the sleeve perpendicular to the longitudinal axis of the high pressure housing 14. However, the port 56 may extend through the sleeve at other angles, as required by the fluid flow pattern desired within the high pressure housing 14. A single port 56 in the sleeve 50 is shown in FIG. 3. However, it will be understood that more than one such port may be provided in the sleeve. If a plurality of ports 56 is present, they are preferably evenly spaced around the sleeve 56, to provide an even flow of fluid through the inner and outer annular cavities 52 and 54. The port 56 is shown in FIG. 3 as being disposed within the sleeve 50 so as to be displaced from alignment with the opening 42 of the port 40 in the high pressure housing 14. If desired, the port 56 may be provided at a different position in the sleeve 50, for example aligned with the opening 42 of the port 40 in the high pressure housing 14. However, the arrangement shown in FIG. 3 is preferred when injection of a slurry of particles, such as cuttings, into the well is contemplated, for the following reason.

As noted above, a slurry of particles, such as drilling cuttings, is an abrasive medium, which, when injected into a wellhead assembly at high flowrates, can lead to erosion of the components of the wellhead and, ultimately, their failure. Thus, in the arrangement shown in FIG. 3, the injection of a slurry of drilling cuttings into the high pressure housing 14, in the absence of the sleeve 50, would allow the slurry particles to impact against the second inner casing string 24 in the region of the opening 42 of the port 40. If allowed to continue, such a practice will lead to a hole forming in the casing and its failure. This in turn would lead to a failure of the high pressure integrity of the entire well and wellhead assembly. As a first measure to prevent this, the sleeve 50 is positioned to allow the incoming fluid to impact its outer surface, thus protecting the second inner casing string 24. In addition, the port 56 in the sleeve 50 is so positioned that the incoming fluid is deviated from flowing in a generally radial direction into the high pressure housing 14 to flowing substantially longitudinally down the first annular cavity 52. At the port 56 in the sleeve 50, the fluid is again diverted to flow radially into the second annular cavity 54, where it is further diverted to flow down the second annular cavity 54, into the annulus 30 and into the well. The aforementioned deviations in the flowpath cause the fluid to lose velocity, such that upon entering the second annular cavity 54, even though the fluid and any particles being carried with it may impact the second inner casing 24, the lower velocity of the fluid reduces the erosion of the casing at this point. Finally, as a further measure to reduce fluid velocity, and hence erosion of the wellhead components due to the flow of fluid, along the flowpath, the total cross-sectional area of the one or more ports 56 in the sleeve 50 can be selected to be greater than the cross-sectional area of the port 40 in the high pressure housing 14.

The port 56 in the sleeve 50 may be formed at an angle, so as to extend inwards and downwards, as viewed in FIG. 3, thus allowing fluid entering the wellhead along the flowpath to strike the second inner casing string 24 at a more acute angle, thus reducing the radial component of the fluid velocity and the erosion of the casing. The port 40 in the high pressure housing 14 may be formed at a similar angle, with a similar effect.

The sleeve 50 may be formed as part of the first or second casing hanger 22, 26. In this embodiment, ports would be located in the second hanger 26 to connect the annulus 52 directly to the annulus 30, extending directly through the second hanger 26. Preferably, the sleeve 50 is a separate component, as shown in FIG. 3, allowing conventional casing hangers to be employed to suspend the first and second inner casing strings 20, 24. In the arrangement shown in FIG. 3, the sleeve 50 is adapted to be landed in the high pressure housing 14 together with the second casing hanger 26 and the second inner casing string 24.

The riser interface assembly 8 is provided to connect a surface vessel or platform with the port 40 in the high pressure housing 14. The riser interface assembly 8 comprises a valve 70, operable to control the flow of fluid along the flowpath either into or out of the wellhead assembly and the well. The valve 70 is mounted to the flange 46 on the spigot 44 by conventional means. Any suitable valve known in the art may be employed in the riser interface assembly 8. The valve selected is preferably of a fail-safe closed arrangement, thus allowing the wellhead assembly and the annulus 30 to be sealed in the event of a failure of the control system. In this way, an uncontrolled discharge of fluid in the annulus 30 and the wellhead assembly is prevented.

A flow loop 72 connects the valve 70 with a riser interface 74, shown more clearly in FIGS. 1 and 2. A riser (not shown) is extended from the surface vessel or platform through the open water and landed on the riser interface 74. In this way, fluid may be introduced into the well or produced from the well. Alternatively, a conventional flowline interface, well known in the art, could be substituted for the riser interface 74, to provide connection of a conduit from a remote site.

In use, fluid, such as a drilling mud, or oil or gas from an underground formation, may be produced from the well up the annulus 30, through the inner annular cavity 54, the port 56 in the sleeve 50, the outer annular cavity 52, leaving the wellhead assembly 2 through the port 40 in the high pressure housing 14. Similarly, fluid may be injected into the well using the aforementioned flowpath in reverse. The present invention is particularly well suited to the injection of a slurry of drilling cuttings into the well, the embodiment shown in FIG. 3 being arranged to minimize the wear on the internal components from such an operation. It is an advantage of the present invention that the central bore of the wellhead assembly remains clear of obstruction, allowing other well operations, such as drilling, to take place while the aforementioned fluid production or injection operations are being carried out. It is to be noted that the present invention requires only a minimum modification of the conventional components used to construct a subsea wellhead assembly. By allowing the conventional casing strings and casing hangers to be employed, the central bore of the wellhead assembly is wholly conventional, requiring no modification to any of the tools or apparatus required for carrying out the well operations. Finally, the riser interface assembly is self-contained and does not requiring the presence of a guide base, in order to the fluid production or injection operations to be carried out.

While the preferred embodiments of the present invention have been shown in the accompanying figures and described above, it is not intended that these be taken to limit the scope of the present invention and modifications thereof can be made by one skilled in the art without departing from the spirit of the present invention.

What I claim is:

1. A wellhead assembly comprising:

a central bore through the wellhead assembly;

a pressure boundary region;

a port in the wellhead assembly having an opening in the central bore in the pressure boundary region of the wellhead assembly;

a first casing string secured at a first end within the wellhead assembly below the opening of the port in the central bore of the wellhead assembly;

a second casing string secured at a first end within the wellhead assembly above the opening of the port in the central bore of the wellhead assembly; and, a sleeve disposed within the wellhead assembly between the first ends of the first and second casing strings, the sleeve having a port therein connecting the port in the wellhead assembly with the annulus between the first and second casing strings, the port in the sleeve is positioned thereby forming a fluid flowpath comprising a first deviation between the opening of the port in the central bore and the annulus between the first and second casing strings and a second deviation at the port in the sleeve.

2. The wellhead assembly as claimed in claim 1, wherein the wellhead assembly comprises a high pressure housing, the port in the wellhead assembly being through the high pressure housing.

3. The wellhead assembly as claimed in claim 2, wherein the first casing string is secured in the high pressure housing.

4. The wellhead assembly as claimed in claim 2, wherein the second casing string is secured in the high pressure housing.

5. The wellhead assembly as claimed in claim 1, wherein the sleeve is separate from the first ends of the first and second casing strings.

6. The wellhead assembly as claimed in claim 5, wherein the sleeve is landed in the wellhead assembly together with the second casing string.

7. The wellhead assembly as claimed in claim 1, further comprising a riser interface assembly connected to the port in the wellhead assembly.

8. The wellhead assembly as claimed in claim 7, wherein the riser interface assembly comprises a valve for regulating the flow of fluid along the flowpath.

9. The wellhead assembly as claimed in claim 8, wherein the valve is a fail-safe closed valve.

10. A method for providing access to an annulus in a well, the well having a wellhead assembly comprising a central bore therethrough, a pressure boundary region within the central bore, the annulus being formed between a first casing string and a second casing secured within the wellhead assembly and extending into the well, the method comprising:

providing a port in the wellhead assembly having an opening into the pressure boundary region of the central bore;

securing the first casing string at a first end in the wellhead assembly below the opening of the port in the central bore;

securing the second casing string at a first end in the wellhead assembly above the opening of the port in the central bore; and, disposing a sleeve within the wellhead assembly between the first ends of the first and second casing strings, the sleeve having a port therein connecting the port in the wellhead assembly with the annulus between the first and second casing strings, the port in the sleeve is positioned thereby forming a fluid flowpath comprising a first deviation between the opening of the port in the central bore and the annulus between the first and second casing strings and a second deviation at the port in the sleeve.

11. The method as claimed in claim 10, wherein the wellhead comprises a high pressure housing, the port in the wellhead assembly being provided through the high pressure housing.

12. The method as claimed in claim 11, wherein the first casing string is secured in the high pressure housing.

13. The method as claimed in claim 11, wherein the second casing string is secured in the high pressure housing.

14. The method as claimed in claim 10, wherein the sleeve is separate from the first ends of the first and second casing strings.

15. The method as claimed in claim 14, wherein the sleeve is landed in the wellhead assembly together with the second casing string.

16. A method for passing a fluid through an annulus in a well, the well having a wellhead assembly comprising a central bore therethrough, a pressure boundary region within the central bore, the annulus being formed between a first casing string and a second casing secured within the wellhead assembly and extending into the well, the method comprising:

providing a port in the wellhead assembly having an opening into the pressure boundary region of the central bore;

securing the first casing string at a first end in the wellhead assembly below the opening of the port in the central bore;

securing the second casing string at a first end in the wellhead assembly above the opening of the port in the central bore; and, thereby forming a fluid flowpath comprising a first deviation between the opening of the port in the central bore and the annulus between the first and second casing strings and a second deviation at the annulus between the first and second casing strings.

17. The method as claimed in claim 16, wherein fluid is passed into the wellhead assembly and the well through the port in the wellhead assembly.

18. The method as claimed in claim 17, wherein the fluid is a slurry of cuttings.

19. The method as claimed in claim 16, wherein fluid is produced from the well through the annulus and out of the wellhead assembly through the port in the wellhead assembly.

* * * * *